US007509894B2

(12) United States Patent
Chen

(10) Patent No.: US 7,509,894 B2
(45) Date of Patent: Mar. 31, 2009

(54) POWER TOOL

(75) Inventor: Ting-Yuan Chen, Taichung Hsien (TW)

(73) Assignee: Ju He Industry Co., Ltd, Taichung Hsien (TW)

( * ) Notice: Subject to any disclaimer, the term of this patent is extended or adjusted under 35 U.S.C. 154(b) by 0 days.

(21) Appl. No.: 11/953,913

(22) Filed: Dec. 11, 2007

(65) Prior Publication Data

US 2008/0178709 A1 Jul. 31, 2008

Related U.S. Application Data

(63) Continuation-in-part of application No. 11/668,265, filed on Jan. 29, 2007, now abandoned.

(51) Int. Cl.
*B25B 17/00* (2006.01)
*B25B 23/16* (2006.01)

(52) U.S. Cl. ..... 81/177.9; 81/57.26

(58) Field of Classification Search ..... 81/177.9, 81/57.13, 57.26, 57.29
See application file for complete search history.

(56) References Cited

U.S. PATENT DOCUMENTS 5,784,934 A 7/1998 Izumisawa ..... 81/57.26
6,311,551 B1 11/2001 Boutaghou ..... 73/105
6,311,583 B1 11/2001 Izumisawa ..... 81/57.13
6,435,060 B1 * 8/2002 Izumisawa ..... 81/57.39
6,877,404 B2 * 4/2005 Chen ..... 81/177.7
6,928,902 B1 8/2005 Eyssallenne ..... 81/57.26
7,104,165 B2 9/2006 Chu ..... 81/177.8

OTHER PUBLICATIONS

Taiwan Patent No. 148266, Dec. 21, 1990, 2pages.

* cited by examiner

*Primary Examiner*—David B Thomas
(74) *Attorney, Agent, or Firm*—Alan Kamrath; Kamrath & Associates PA

(57) ABSTRACT

A power tool comprises a handle, a head pivotally coupling to the handle, an operating member disposed on the head, a positioning element installed in the head and biased with an elastic element for fixing the head in a desired position relative to the handle. The operating member has a pressing portion and a receiving portion. While the operating member is in a first position, the pressing portion of the operating member abuts against the positioning element to press the positioning element to engage to the handle so that the head is fixed in position relative to the handle; while the operating member is in a second position, the elastic element is released to push the positioning element toward the receiving portion of the operating member so that the positioning element disengages from the handle and the head can pivot relative to the handle freely.

19 Claims, 12 Drawing Sheets

POWER TOOL

CROSS-REFERENCE

The present patent application is a continuation-in-part application of U.S. patent application Ser. No. 11/668,265 filed Jan. 29, 2007, now abandoned.

BACKGROUND OF INVENTION

1. Field of the Invention

The present invention relates to a power tool.

2. Description of the Related Art

Referring to U.S. Pat. No. 6,311,551, a power ratchet wrench 21 includes a handle 23, a head 25 extending from an end of the handle 23 and a locking mechanism 101 disposed in the center of the handle 23. The locking mechanism 101 includes a pivot pin 103 inserting therethrough, two fasteners 109, 113 respectively engaging with two ends of the pivot pin 103 as to secure the pivot pin 103 in the wrench 21, a knob 117 and two locking pins 103. While the locking mechanism 101 is in the adjusting mode, the locking pins 103 disengage form the slots 129, 133 and the head 25 can pivot relative to the handle 23. While the locking mechanism 101 is in the locking mode, the locking pins 103 engage with the slots 129, 133 as to locate the head 25 in a desired angle.

However, the locking mechanism 101 is switched between the adjusting mode and the locking mode via operating the knob 117. Hence, the fixing size of the knob 117 cannot fill the requirements of all users. Further, each slot 133 separates from one another via a quite thin wall so that during the locking pins 103 move between the slots 133 repeatedly, the slots 133 will be out of shape easily.

SUMMARY OF THE INVENTION

It is therefore the purpose of this invention to provide a power tool, which comprises a handle, a head pivotally coupling to the handle, an operating member disposed on the heads a positioning element installed in the head and biased with an elastic element for fixing the head in a desired position relative to the handle. The operating member has a pressing portion and a receiving portion. While the operating member is in a first position, the pressing portion of the operating member abuts against the positioning element to press the positioning element to engage to the handle so that the head is fixed in position relative to the handle; while the operating member is in a second position, the elastic element is released to push the positioning element toward the receiving portion of the operating member so that the positioning element disengages form the handle and the head can pivot relative to the handle freely.

Other objectives, advantages, and features of the invention will become more apparent from the following detailed description when taken in conjunction with the accompanying drawings.

DETAILED DESCRIPTION OF THE PREFERRED EMBODIMENT

Figure 1:
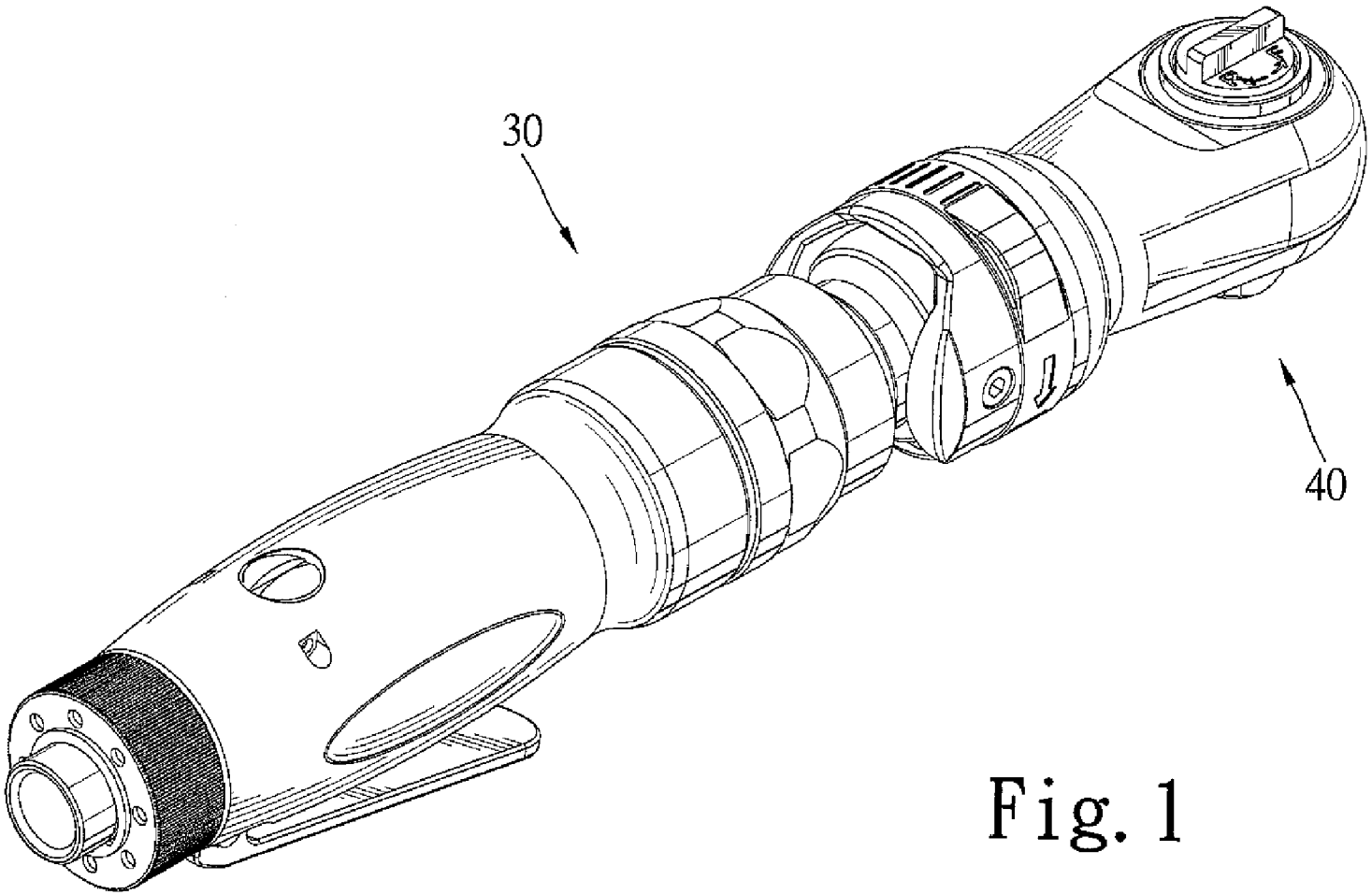
FIG. 1 is a perspective view of a power tool in accordance with the present invention.
Figure 2:
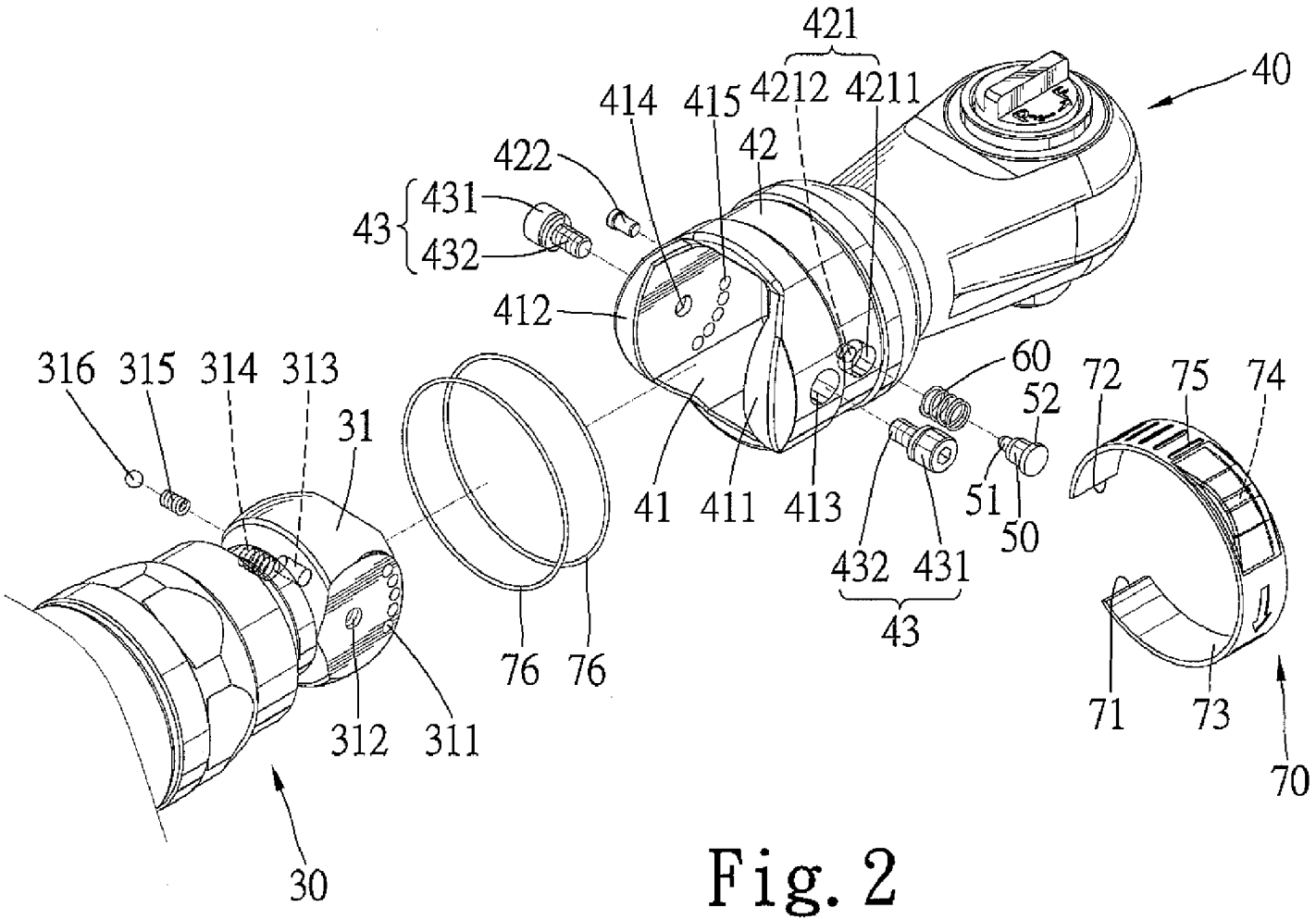
FIG. 2 is an exploded view of the power tool in accordance with the present invention.
Figure 3:
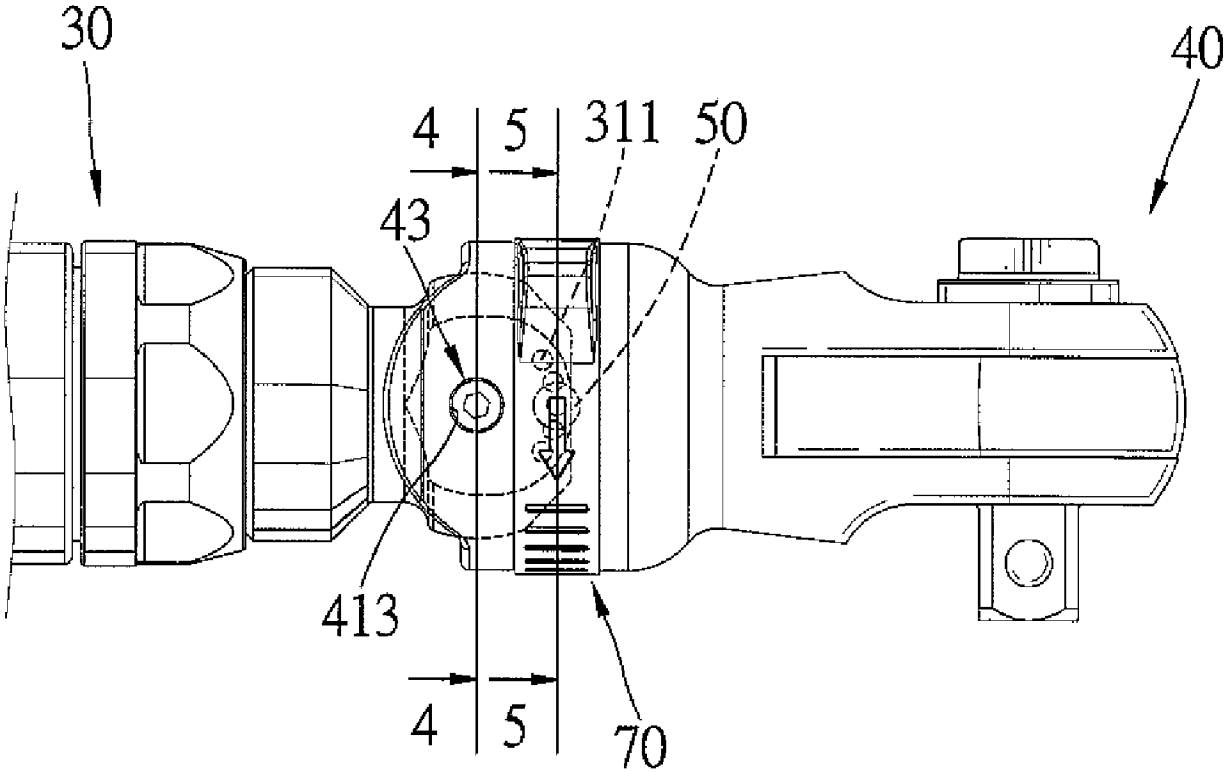
FIG. 3 is a side view in FIG. 1.
Figure 4:
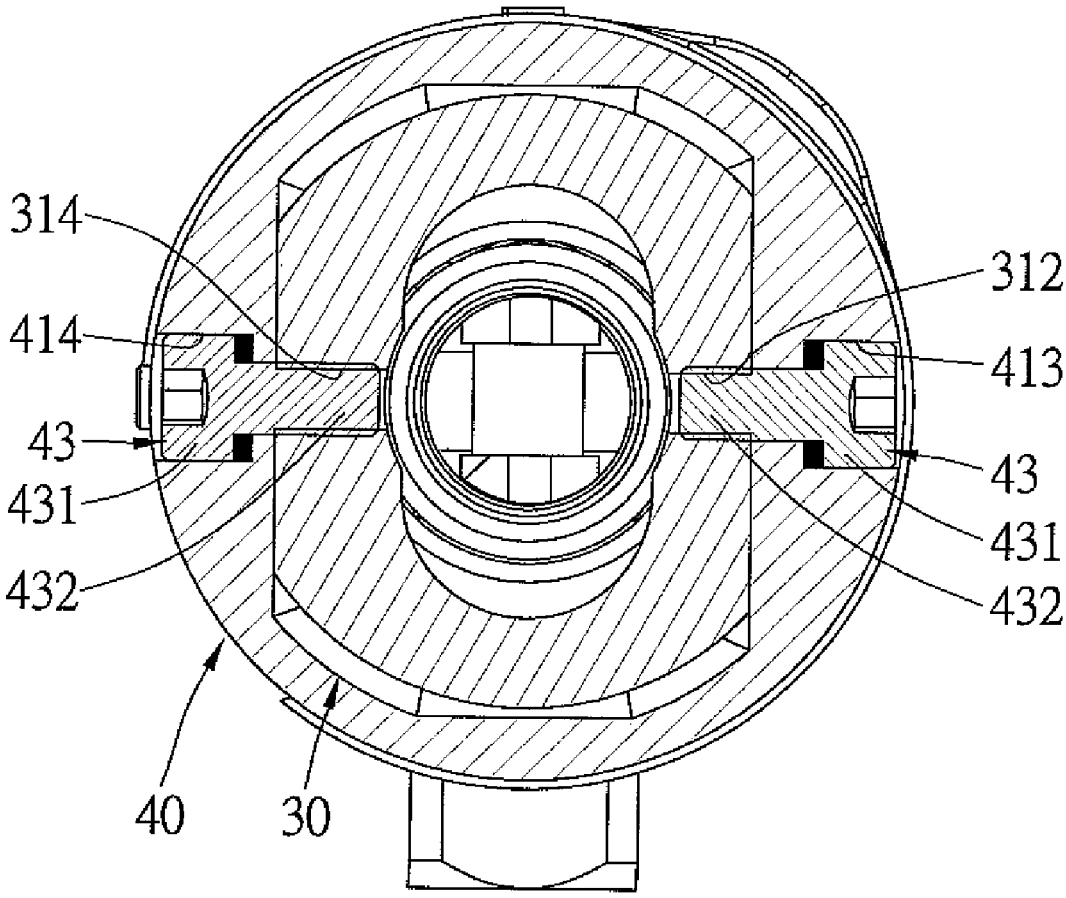
FIG. 4 is a sectional view taken along plane 4-4 in FIG. 3, illustrating the head of the wrench pivotally coupling with the handle of the wrench.

Referring to FIGS. 1 and 2, a power tool includes a handle 30, a head 40 pivotally coupling to the handle 30, an operating member 70 disposed on the head 40, and a positioning element 50 installed in the head 30 and biased with an elastic element 60 for fixing the head 40 in a desired position relative to the handle 30.

The handle 30 includes a connected portion 31 formed on an end thereof, a plurality of retained holes 311 defined on a side of the connected portion 31 and arranged along the edge of the connected portion 31, and a first threaded hole 312 defined adjacent to the retained holes 311, with each retained hole 311 being equally distant from the first threaded hole 312, with the middle retained hole 311 being the same horizontal position on the side of the connected portion 31 as the first threaded hole 312.

The connected portion 31 further includes a fixed hole 313 defined on another side opposite to the first threaded hole 312, a second threaded hole 314 adjacent to the fixed hole 313, a spring 315 and a ball 316, with the fixed hole 313 receiving the spring 315 and the ball 316.

The head 40 includes a compartment 41, which is formed in an end thereof and adapted to receive the connected portion 31, a groove 42 formed on the outer periphery thereof and encompassing the compartment 41, and two screw members 43 for pivotally coupling the head 40 to the connected portion 31 of the handle 30. A receiving hole 421 is formed through the groove 42 and communicates with the compartment 41. The receiving hole 421 has a connective portion 4211 and a reduced portion 4212 contiguously formed with the connective portion 4211, with the reduced portion 4212 being adjacent to the compartment 41, with the inside diameter of the reduced portion 4212 being smaller than that of the connective portion 4211.

The compartment 41 includes a first and a second lugs 411, 412 extending from two walls thereof respectively, and a first and a second pivot holes 413, 414 defined on the first and second lugs 411, 412 respectively. The first and second pivot holes 413, 414 correspond to the first and second threaded holes 312, 314 respectively, with the two screw members 43 adapted for engaging the first and second pivot holes 413, 414 to the first and second threaded holes 312, 314 respectively so that the head 40 can pivot relative to the handle 30.

Each screw member 43 includes a first end 431 and a second end 432, with the form of the interior wall of the first and second pivot holes 413, 414 corresponding to the form of screw members 43 respectively. Therefore, the first ends 431 do not protrude from the first and second pivot holes after engaging the head 40 to the handle 30.

The compartment 41 further includes a plurality of retained holes 415 defined on the inner wall thereof adjacent to the second lug 412 and arranged as a curve corresponding to each position of the ball 316 disposed in the fixed hole 313 while the head 40 pivots relative to the handle 30. Each retained hole 415 is equally distant from the second pivot hole 414, and the most upper retained hole 415 is in the same horizontal position on the wall of the compartment 41 with the second pivot hole 414. And the most upper retained hole 415 is provided for being through the wall of the compartment 41 and adapted for receiving a block 422 from the outer periphery of the compartment 41. When the head 40 pivots relative to the handle 30, the fixed hole 313 is adapted for corresponding to a selected retained hole 415. So that the spring 315 biases the ball 316 into the selected retained hole 415 for fixing the head 40 in a desired position relative to the handle 30.

The positioning element 50 is disposed in the receiving hole 421 and includes a positioning end 51 defined on an end thereof and a blocking end 52 formed on another end thereof, with the positioning end 51 adapted for inserting into one of the retained holes 311 through the reduced portion 4212 of the receiving hole 421.

The elastic element 60 is disposed between the receiving hole 421 of the groove 42 and the reduced portion 4212 of the receiving hole 421 and provided resilient to the positioning element 50 as to slightly bias the positioning element 50 outwardly.

The operating member 70 is rotatably mounted on the groove 42, with the profile of the operating member 70 being C-shaped, with the width of the operating member 70 being a little narrower than that of the groove 42 so that the operating member 70 can smoothly rotate in the groove 42. The operating member 70 includes a first end 71, a second end 72, a pressing portion 73, which is defined on the inner surface thereof adjacent to the first end 71 and adapted for abutting against the positioning element 50 for pressing the positioning element 50 inwardly, a receiving portion 74, which is defined adjacent to the second end 72 and provided a space for receiving the blocking end 52 of the positioning element 50 that is biased outwardly by the elastic element 60, an anti-slipping portion 75 formed on the outer surface thereof for a user operating the operating member 70 easily, and two O-rings 76 disposed in two interstices that are defined between two sidewalls of the grooves 42 and the operating member 70 respectively. The O-rings 76 provides more friction between the operating member 70 and the groove 42 as to prevent the operating member 70 coming off the groove 42 easily in use.

Figure 5:
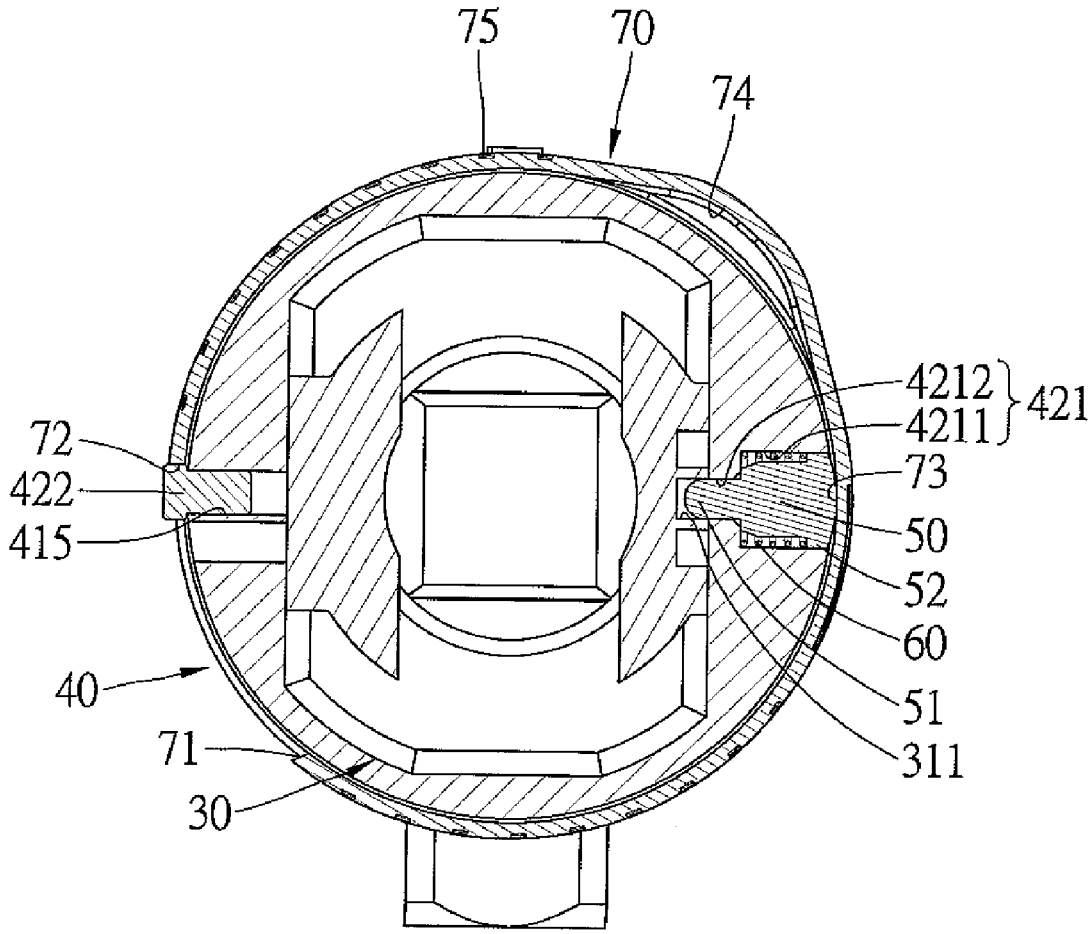
FIG. 5 is a sectional view taken along plane 5-5 in FIG. 3, illustrating the operating member in a first position.
Figure 6:
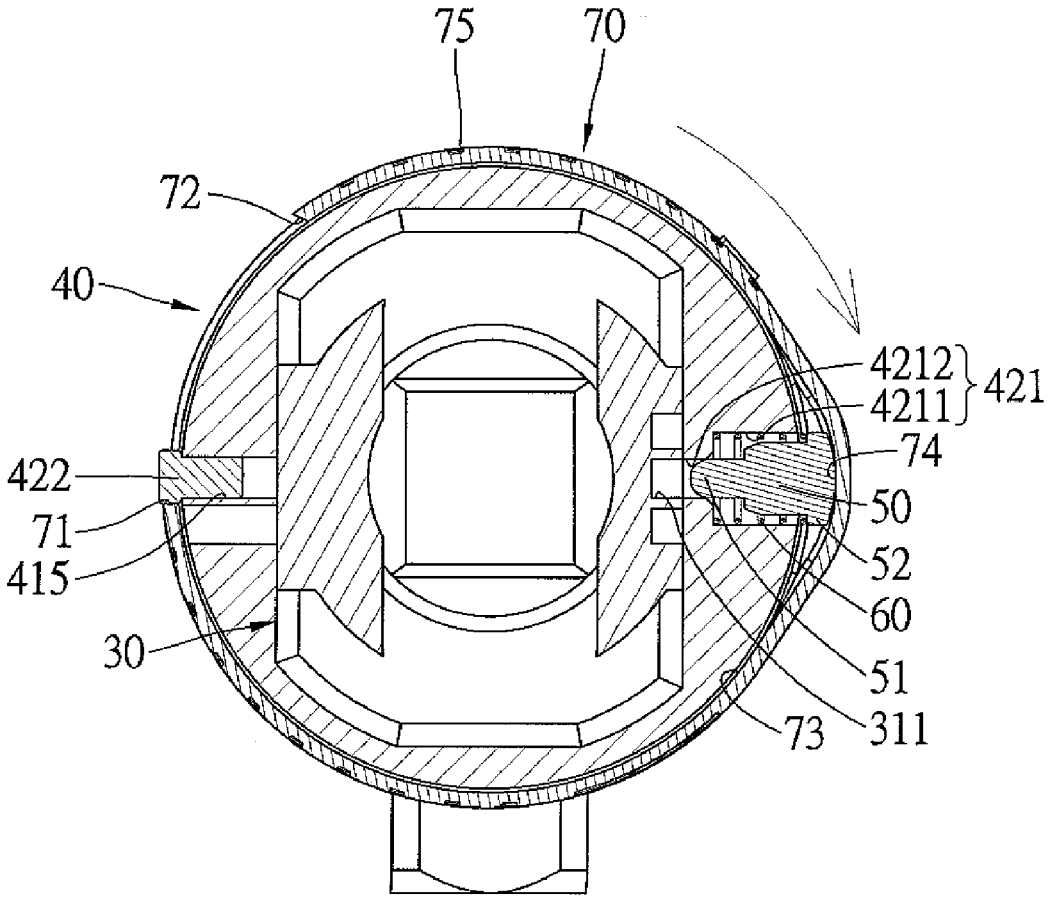
FIG. 6 is a sectional view similar to FIG. 5, illustrating the operating member in a second position.

Especially referring to FIGS. 5 and 6 it shows that the elastic element 60 biases the positioning element 50 toward the operating member 70, and the block 422 is received in the most upper retained hole 415. While the operating member 70 is in a first position (shown in FIG. 5), the second end 72 of the operating member 70 contacts with the block 422, and the pressing portion 73 of the operating member 70 presses the positioning element 50 inwardly. Therefore, the elastic element 60 is pressed, and the positioning end 51 inserts into one of the retained holes 311. The head 40 is fixed and cannot pivot relative to the handle 30.

Next rotating the operating member 70 on the groove 42 to a second position (shown in FIG. 6), the first end 71 of the operating member 70 abuts against the block 422, and the positioning element 50 that is pushed by the released elastic element 60 moves outwardly so that the blocking end 52 of the positioning element 50 is received in the receiving portion 74. The positioning end 51 of the positioning element 50 disengages from the related retained hole 311 of the handle 30. Meanwhile the head 40 can pivot relative to the handle 30 freely.

Figure 7:
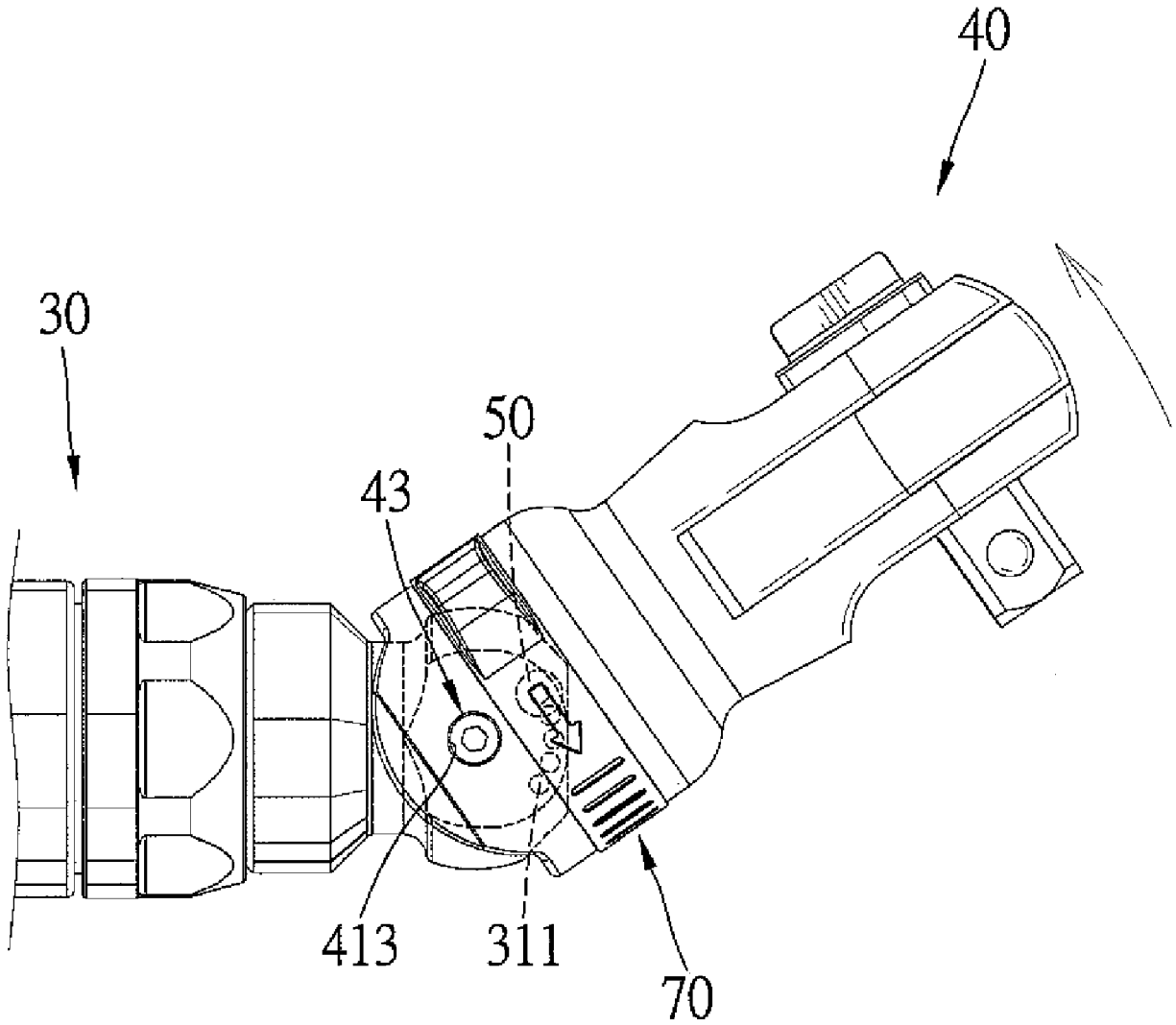
FIG. 7 is a side view similar to FIG. 3, illustrating the head pivoting relative to the handle counterclockwise.
Figure 8:
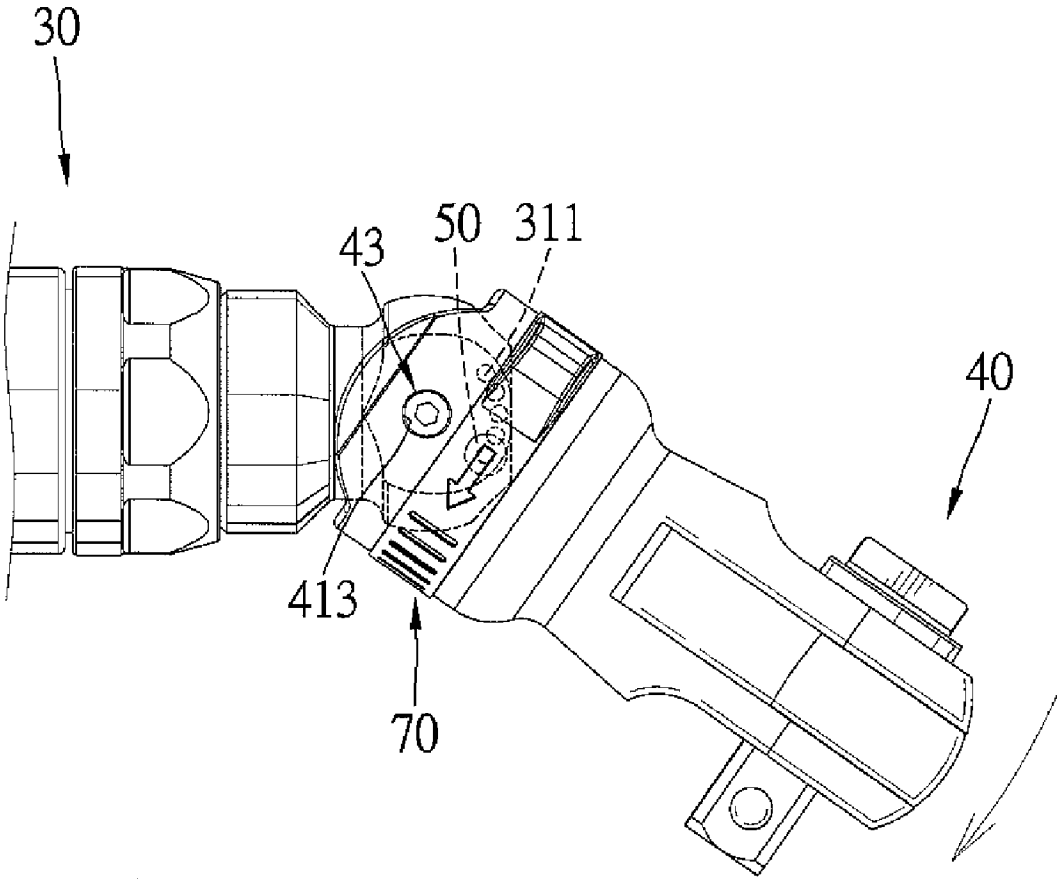
FIG. 8 is a side view similar to FIG. 3, illustrating the head pivoting relative to the handle clockwise.

Referring to FIGS. 7 and 8, the head 40 pivotally couples to the handle 30 via the screw members 43 and can either pivot relative to the handle 30 clockwise or counterclockwise. And the moving trajectory of the positioning element 50, which pivots by the head 40, corresponds to the arrangement of the retained holes 311. Therefore, by the positioning element 50 inserting into one of the retained holes 311, the head 40 can be fixed in a desired position.

Figure 9:
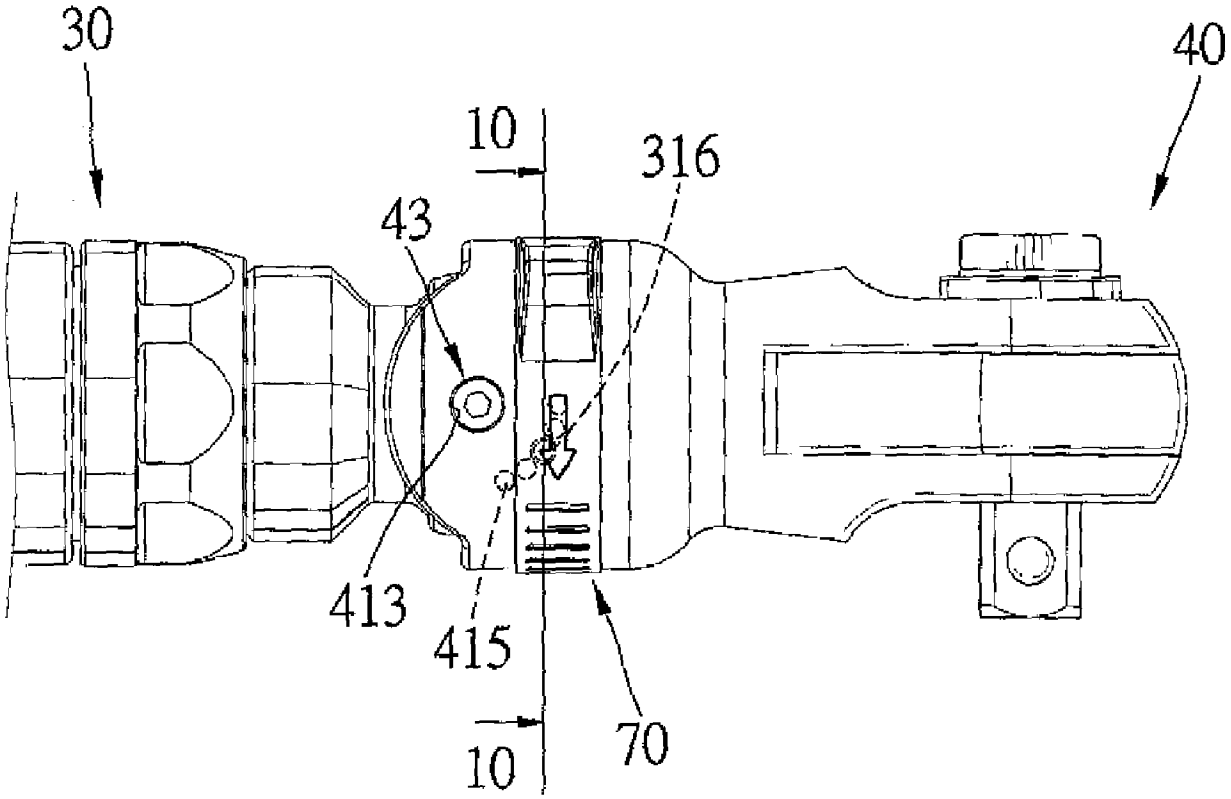
FIG. 9 is a side view similar to FIG. 3.
Figure 10:
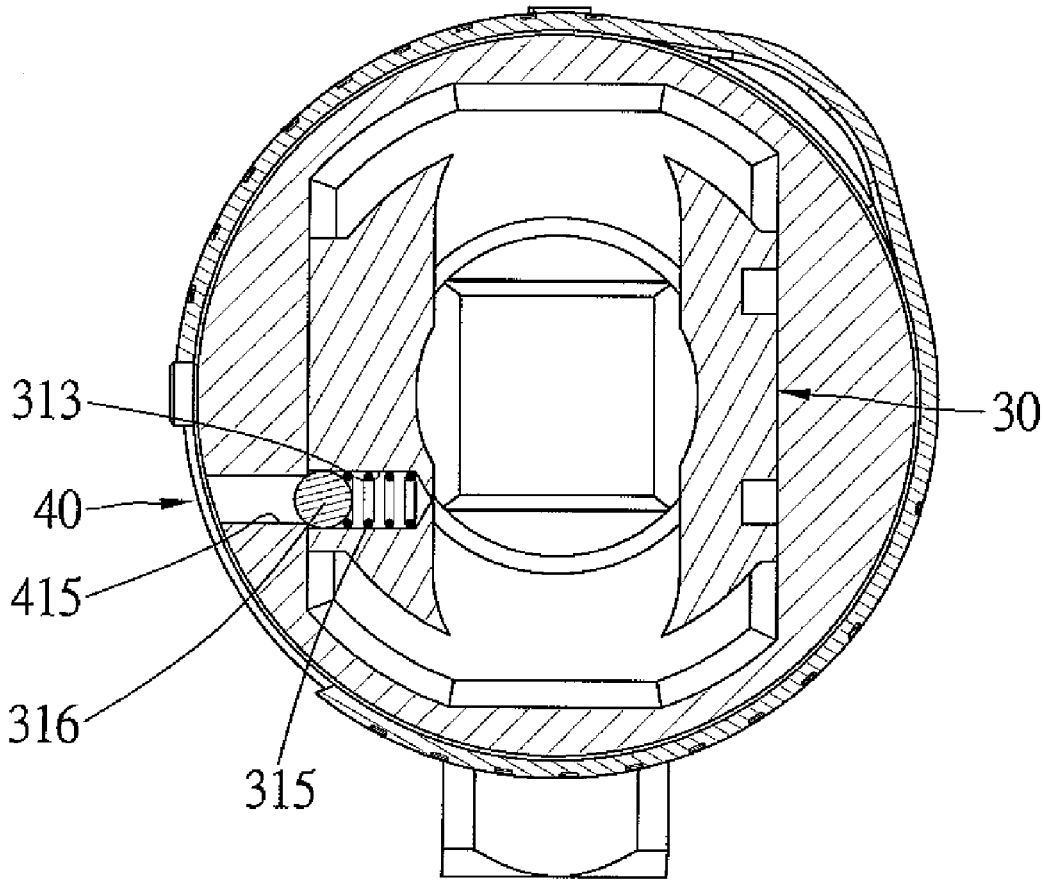
FIG. 10 is a sectional view taken along plane 10-10 in FIG. 9.

Referring to FIGS. 9 and 10, both the ball 316 and the spring 315 disposed in the fixed hole 313. The spring 315 biases the ball 316 to fix into a selected retained hole 415 adjacent to the handle 30 as to fix the head 40 in a desired position.

Figure 11:
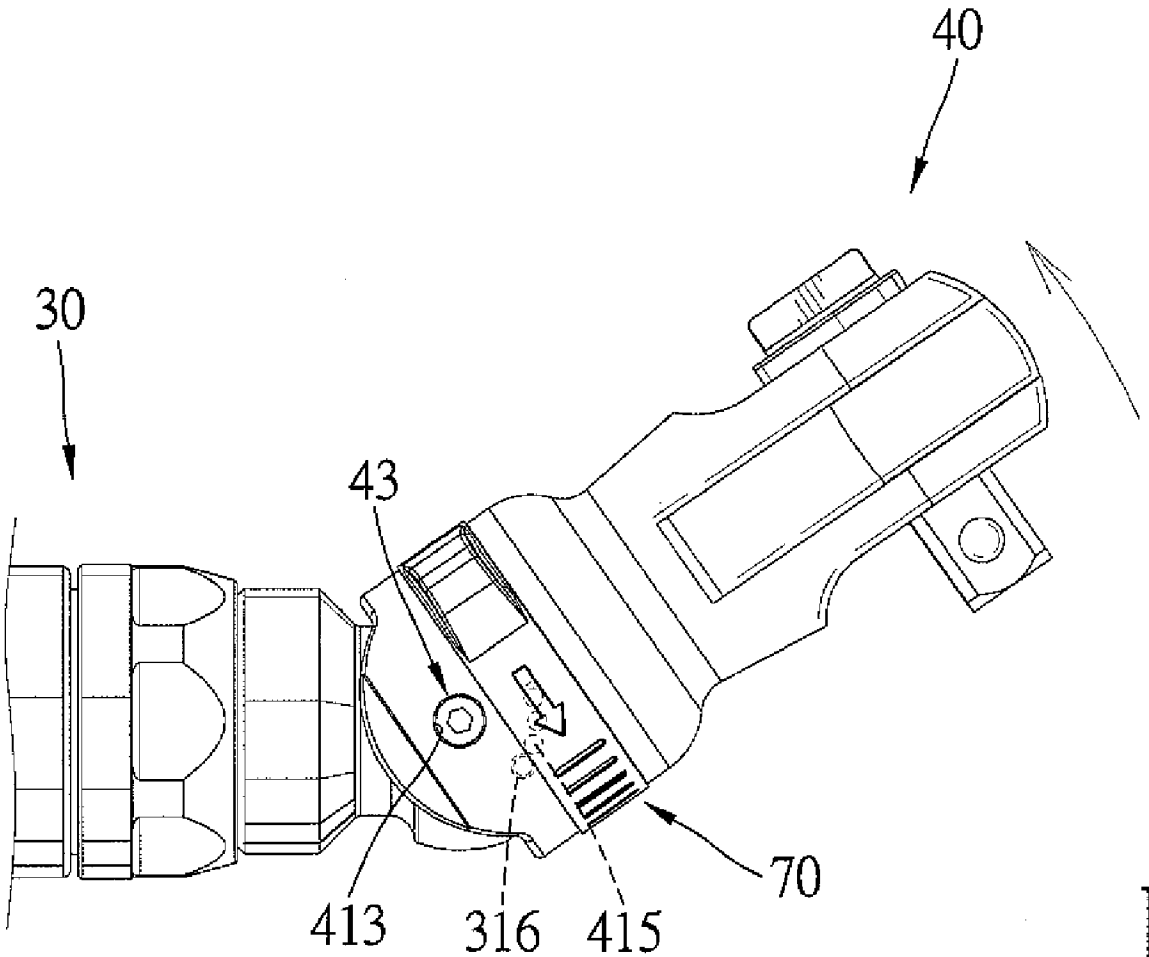
FIG. 11 is a side view similar to FIG. 9, illustrating the head pivoting relative to the handle counterclockwise.
Figure 12:
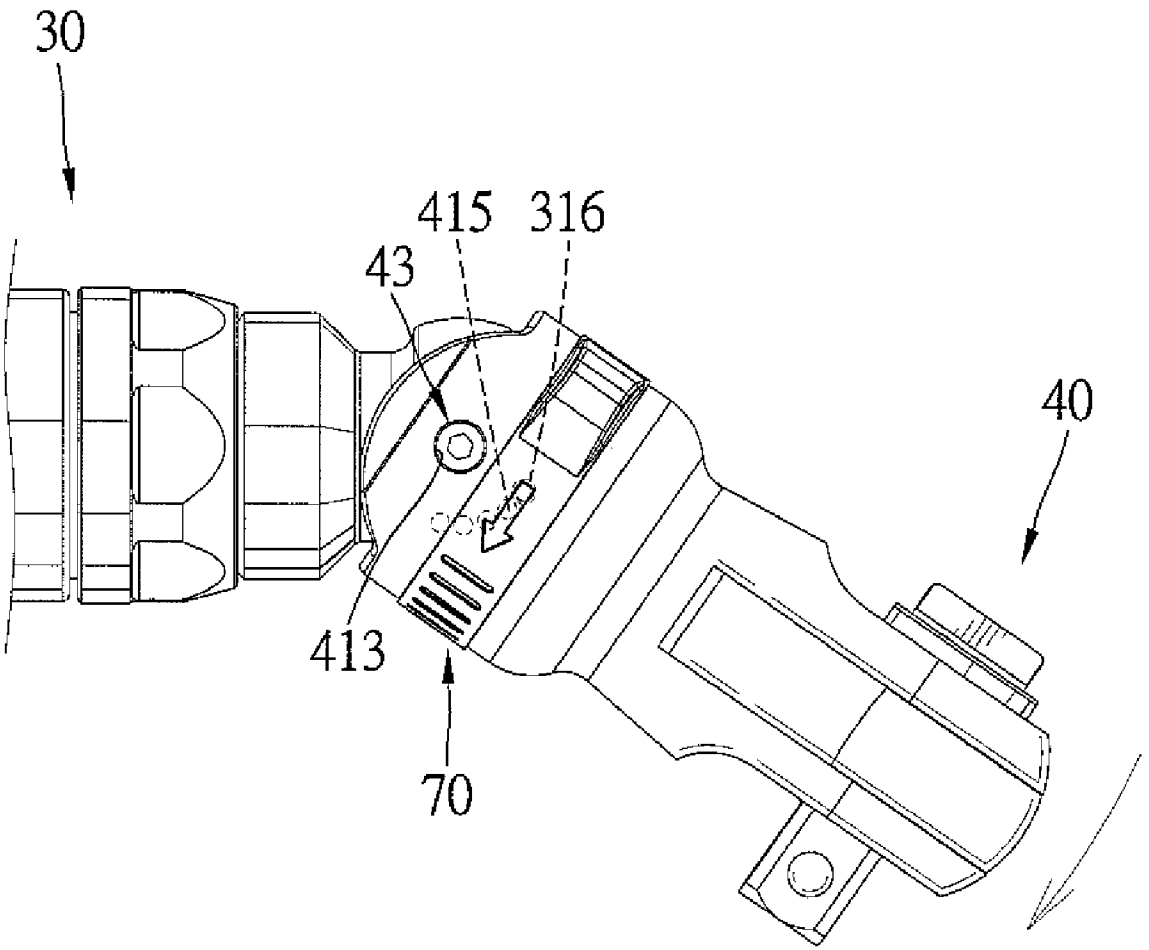
FIG. 12 is a sectional view similar to FIG. 9, illustrating the head pivoting relative to the handle clockwise.

Referring to FIGS. 11 and 12, the head 40 pivotally couples to the handle 30 via the screw members 43 and can either pivot relative to the handle 30 clockwise or counterclockwise. The arrangement of the retained holes 415 on the inner wall of the compartment 41 corresponds to the moving trajectory of the ball 316 disposed on the handle 30. Furthermore, when the ball 316 is pushed into a selected retained hole 415 to fix the head 40 relative to the handle 30, in the meanwhile, the positioning element 50 can insert into the related retained hole 311 to further fix the head 40 in the same position.

Although a specific embodiment has been illustrated and described, numerous modifications and variations are still possible. The scope of the invention is limited by the accompanying claims.

What is claimed is:

1. A power tool comprising: a handle; a head including a compartment adapted for pivotally coupling to the handle, and a receiving hole communicating with the compartment; a positioning element inserting through the receiving hole of the head and engaging with the handle; an elastic element received in the receiving hole and mounted on the positioning element; and an operating member rotatably disposed on the head and including a pressing portion and a receiving portion; wherein while the operating member is in a first position, the pressing portion abuts against the positioning element for pressing the positioning element through the head to engage with the handle; while the operating member is in a second position, the elastic element is released to push the positioning element toward the operating member so that the positioning element disengages from the handle and is partially received in the receiving portion.

2. The power tool as claimed in claim 1, wherein the handle further comprising a connecting portion formed on an end thereof and received in the compartment of the head, a first and a second threaded holes defined on two sides of the connecting portion; wherein the head includes a first and a second pivot holes that correspond to the first and second threaded holes respectively and two screws, the screws being adapted for inserting through the first and second threaded holes to the first and second pivot holes to pivotally couple the head to the connecting portion of the handle.

3. The power tool as claimed in claim 1, the head further comprising a groove formed thereon for receiving the operating member, with the receiving hole defined on the groove.

4. The power tool as claimed in claim 1, the head further comprising a retaining hole formed through the compartment opposite to the receiving hole and a block received in the retaining hole, with the block adapted for blocking the operating member.

5. The power tool as claimed in claim 3, the head further comprising a retaining hole formed through the groove opposite to the receiving hole and a block received in the retaining hole, with the block adapted for blocking the operating member.

6. The power tool as claimed in claim 4, wherein the operating member has a first end adjacent to the pressing portion and a second end adjacent to the receiving portion; wherein while the operating member is in the first position, the second end of the operating member abuts against the block of the head and the first end of the operating member is away from the block; wherein while the operating member is in the second position, the first end of the operating member abuts against the block of the head and the second end of the operating member is away from the block.

7. The power tool as claimed in claim 5, wherein the operating member has a first end adjacent to the pressing portion and a second end adjacent to the receiving portion; wherein while the operating member is in the first position, the second end of the operating member abuts against the block of the head and the first end of the operating member is away from the block; wherein while the operating member is in the second position, the first end of the operating member abuts against the block of the head and the second end of the operating member is away from the block.

8. The power tool as claimed in claim 1, with the receiving hole having a connective portion and a reduced portion, with the positioning element having a positioning end adapted disposed in the reduced portion of the receiving hole and a blocking end for being received in the receiving portion of the operating member in the second position.

9. The power tool as claimed in claim 3, with the receiving hole having a connective portion and a reduced portion, with the positioning element having a positioning end adapted disposed in the reduced portion of the receiving hole and a blocking end for being received in the receiving portion of the operating member in the second position.

10. The power tool as claimed in claim 3 further comprising at least one O-ring between the groove and the operating member.

11. The power tool as claimed in claim 1, wherein the profile of the operating member is C-shaped.

12. A power tool comprising: a handle including a connecting portion formed on an end thereof, a head including a groove formed thereon, a compartment adapted to pivotally couple to the connecting portion of the handle, and a receiving hole defined on the groove and communicating with the compartment; a positioning element inserting through the receiving hole of the head and engaging with the handle; an elastic element received in the receiving hole and mounted on the positioning element; and an operating member rotatably disposed on the groove and including a pressing portion and a receiving portion; wherein the connecting portion includes at least one retaining hole corresponding to the positioning element; wherein while the operating member is in a first position, the pressing portion abuts against the positioning element for pressing the positioning element through the head to insert into one of the at least one retaining hole of the handle; while the operating member is in a second position, the elastic element is released to push the positioning element toward the operating member so that the positioning element disengages from said retaining hole of the handle and is partially received in the receiving portion.

13. The power tool as claimed in claim 12, wherein the connecting portion includes a first and a second threaded hole defined on two sides thereof, wherein the head includes a first and a second pivot hole that correspond to the first and second threaded holes respectively and two screws, the screws being adapted for inserting through the first and second threaded holes to the first and second pivot holes to pivotally couple the head to the connecting portion of the handle.

14. The power tool as claimed in claim 12, the groove further comprising a retaining hole therethrough and a block received in the retaining hole, with the block adapted for blocking the operating member.

15. The power tool as claimed in claim 14, wherein the operating member has a first end adjacent to the pressing portion and a second end adjacent to the receiving portion; wherein while the operating member is in the first position, the second end of the operating member abuts against the block of the head and the first end of the operating member is away from the block; wherein while the operating member is in the second position, the first end of the operating member abuts against the block of the head and the second end of the operating member is away from the block.

16. The power tool as claimed in claim 12, with the receiving hole having a connective portion and a reduced portion, with the positioning element having a positioning end adapted disposed in the reduced portion of the receiving hole and a blocking end for being received in the receiving portion of the operating member in the second position.

17. The power tool as claimed in claim 12 further comprising at least one O-ring between the groove and the operating member.

18. The power tool as claimed in claim 12, wherein the profile of the operating member is C-shaped.

19. The power tool as claimed in claim 12, wherein the connecting portion further comprises a fixing hole formed on another side thereof opposite to the retaining holes and a spring and a ball disposed in the fixing hole; wherein the compartment defines at least one retaining hole in the inner wall thereof and corresponding to the fixing hole of the handle.

* * * * *